US008528867B1

(12) United States Patent
Carmo

(10) Patent No.: US 8,528,867 B1
(45) Date of Patent: Sep. 10, 2013

(54) MULTI-USE BAG, BAG STAND, AND MULTI-USE BAG AND BAG STAND ACCESSORIES

(76) Inventor: Robert A Carmo, Placentia, CA (US)

( * ) Notice: Subject to any disclaimer, the term of this patent is extended or adjusted under 35 U.S.C. 154(b) by 0 days.

(21) Appl. No.: 13/483,641

(22) Filed: May 30, 2012

(51) Int. Cl.
*A63B 55/04* (2006.01)

(52) U.S. Cl.
USPC ..... 248/97; 383/11; 383/15; 383/210

(58) Field of Classification Search
USPC ..... 248/95, 97, 99, 100, 101; 383/11, 383/15, 37, 210
See application file for complete search history.

(56) References Cited

U.S. PATENT DOCUMENTS

| | | | | | |
|---|---|---|---|---|---|
| 805,708 | A * | 11/1905 | Byrd | 280/845 |
| 2,815,186 | A * | 12/1957 | Miller | 248/99 |
| 2,900,156 | A * | 8/1959 | Styers | 248/99 |
| 3,632,029 | A * | 1/1972 | Sonner | 224/275 |
| 3,646,723 | A * | 3/1972 | Meroney | 53/390 |
| 3,707,271 | A * | 12/1972 | Sanchez et al. | 248/101 |
| 3,861,630 | A * | 1/1975 | Ady | 248/100 |
| 4,981,216 | A * | 1/1991 | Wilfong, Jr. | 206/554 |
| 5,183,227 | A * | 2/1993 | Wilhite | 248/99 |
| 5,333,730 | A * | 8/1994 | Boyd | 206/554 |
| 5,335,788 | A * | 8/1994 | Beasley et al. | 206/554 |
| 6,641,187 | B2 * | 11/2003 | Hsu | 294/214 |
| 7,318,525 | B2 * | 1/2008 | Dickinson | 206/554 |
| 7,575,675 | B2 * | 8/2009 | Gopalan | 210/167.1 |
| 7,806,594 | B2 * | 10/2010 | Trinko | 383/37 |
| 8,192,083 | B2 * | 6/2012 | Bautista | 383/9 |
| 2002/0074260 | A1 * | 6/2002 | Huang et al. | 206/554 |
| 2005/0029133 | A1 * | 2/2005 | Maehashi et al. | 206/308.1 |
| 2007/0186515 | A1 * | 8/2007 | Ruetten et al. | 53/502 |
| 2010/0314507 | A1 * | 12/2010 | Laitila et al. | 248/97 |
| 2011/0026857 | A1 * | 2/2011 | Bautista | 383/12 |

* cited by examiner

*Primary Examiner* — Bradley Duckworth
(74) *Attorney, Agent, or Firm* — The Law Office of Austin Bonderer, PC; Austin Borderer

(57) ABSTRACT

An apparatus including a bag is disclosed. The bag includes a first panel, a second panel, a first fastener located on the first panel, and a second fastener located on the second panel. The bag is able to move between an open position and a closed position. In the closed position, the first fastener is releasably secured to the second fastener. In the open position, the first fastener is not in contact with the second fastener. Some embodiments also include a bag stand and a catch.

13 Claims, 7 Drawing Sheets

MULTI-USE BAG, BAG STAND, AND MULTI-USE BAG AND BAG STAND ACCESSORIES

BACKGROUND OF THE INVENTION

The invention relates to multi-use bags, bag stands, multi-use bag and bag stand accessories that enable ease of using, storing and filling multi-use bags.

SUMMARY OF THE INVENTION

An apparatus comprising:

a bag comprising:

a first panel;

a second panel;

a first fastener located on the first panel; and a second fastener located on the second panel;

wherein the bag is able to move between an open position and a closed position; in the closed position, the first fastener is releasably secured to the second fastener; and in the open position, the first fastener is not in contact with the second fastener.

The bag further comprises a third fastener and a fourth fastener; the first panel comprises a first interior surface and a first exterior surface; the second panel comprises a second interior surface and a second exterior surface; first fastener is located on the first interior surface, the third fastener is located on the first exterior surface; the second fastener is located on the second interior surface; and the fourth fastener is located on the second exterior surface.

The first panel comprises a first interior surface and a first exterior surface; the second panel comprises a second interior surface and a second exterior surface; and the first fastener extends from the first interior surface to the first exterior surface, and the second fastener extends from the second interior surface to the second exterior surface.

The apparatus further comprising a catch; and the catch comprises a fastener section that is releasably connected to either the third fastener or the fourth fastener.

The apparatus further comprising a catch; and the catch comprises a fastener section that is releasably connected to either the first fastener or the second fastener.

The apparatus further comprising a bag stand comprising a hook; and the catch defines a though hole, and the hook is located in the through hole.

The apparatus further comprising a bag stand and a catch; the bag stand comprises a hook; the catch comprises a fastening section, that is releasably connected to either the third fastener or the fourth fastener, and defines a through hole in which the hook is engaged; and the catch is able to rotate in relation to the hook such that the hook is able to disengage from the through hole, but the catch will still be attached to the bag stand.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION OF THE DRAWINGS

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
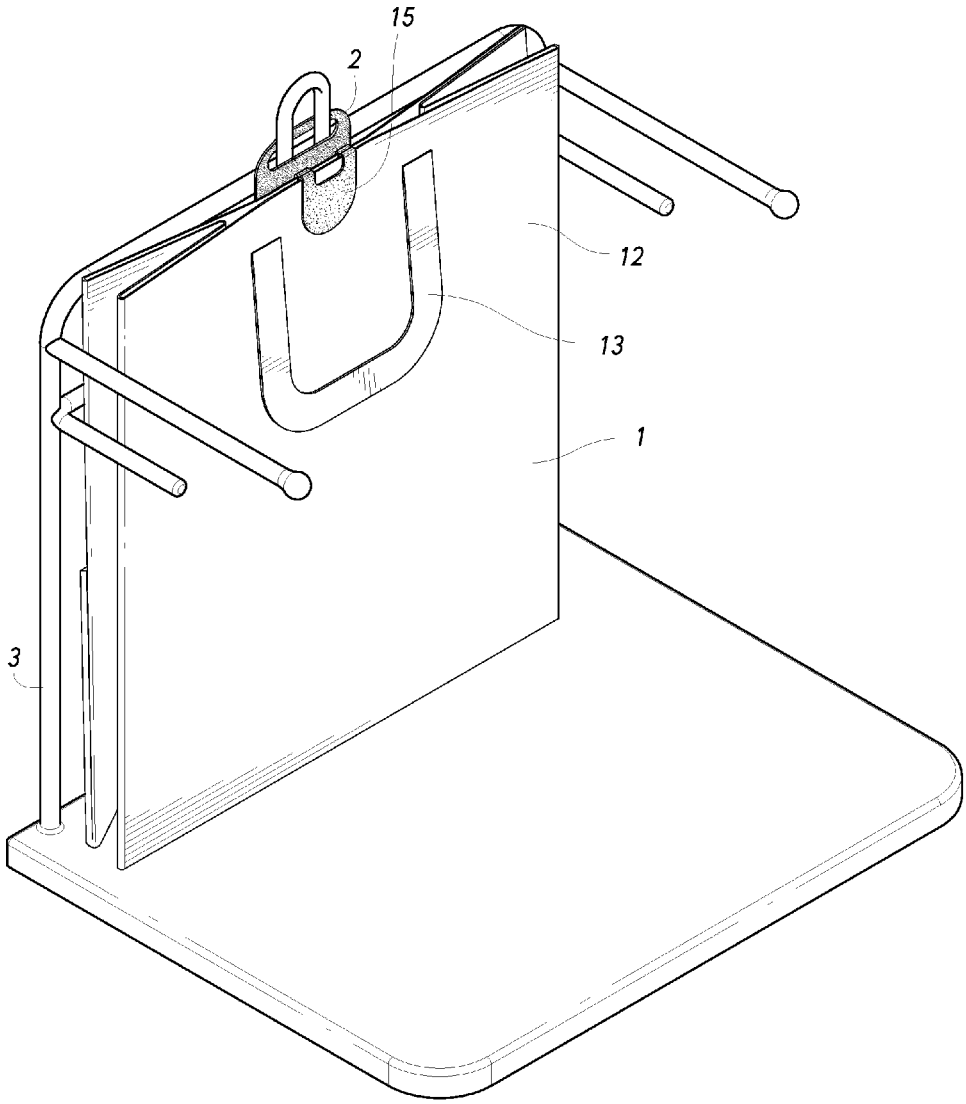
FIG. 1 shows an embodiment of a bag and a bag stand.

Referring to FIG. 1, a bag 1 is attached to a bag stand 3. The bag 1 comprises of a first panel 11, a second panel 12, a handle 13, a first fastener 14 and a second fastener 15. The first panel 11 has a first interior surface 110 and a first exterior surface 111. The second panel 12 has a second interior surface 120 and a second exterior surface 121. Also shown is a catch 2 having a through hole 21 and a fastening section 22. A bag stand 3 comprises a hook 31, and the hook 31 is shown being received in the through hole 21.

Figure 5:
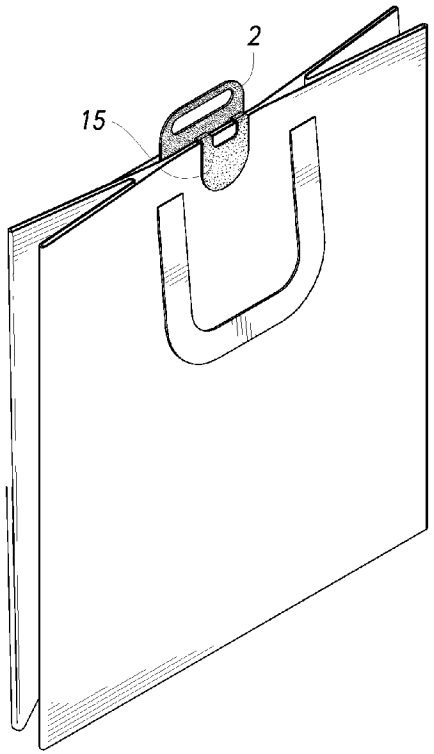
FIGS. 4 and 5. shows an embodiment of the fasteners and a catch.
Figure 4:
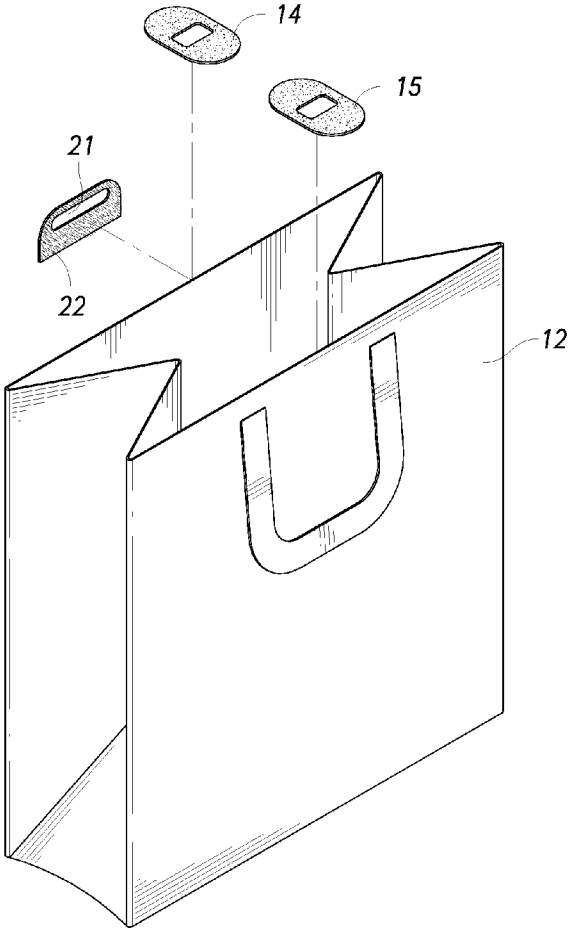

When the bag 1 is in a closed position, the first fastener 14 and the second fastener 15 are releasably secured to each other and will hold the bag 1 closed. When the first fastener 14 and the second fastener 15 are separated, the bag 1 is placed in an open position. In some embodiments (as seen in FIGS. 4 and 5), the first fastener 14 extends from the first interior surface 110 to the first exterior surface 111, and the second fastener 15 extends from the second interior surface 120 to the second exterior surface 121.

The fastener section of the catch 2 can be secured to the first fastener 14. The through hole 21 of the catch 2 can be hooked on the hook 31 of the bag stand 3. A user is able to separate the first fastener 14 and the second fastener 15 and position the bag 1 in the open position. The first panel 11 will stay attached to the bag stand 3, while the second panel 12 is moved away from the first panel 11. Thus the bag 1 will be conveniently open, but it will also be stable so that the bag 1 can be easily filled with items. Once the bag 1 is filled, the first fastener 14 can be disconnected from the fastening section 22 of the catch 2 or the catch 2 can be unhooked and remain in contact with the first fastener 14.

Figure 2:
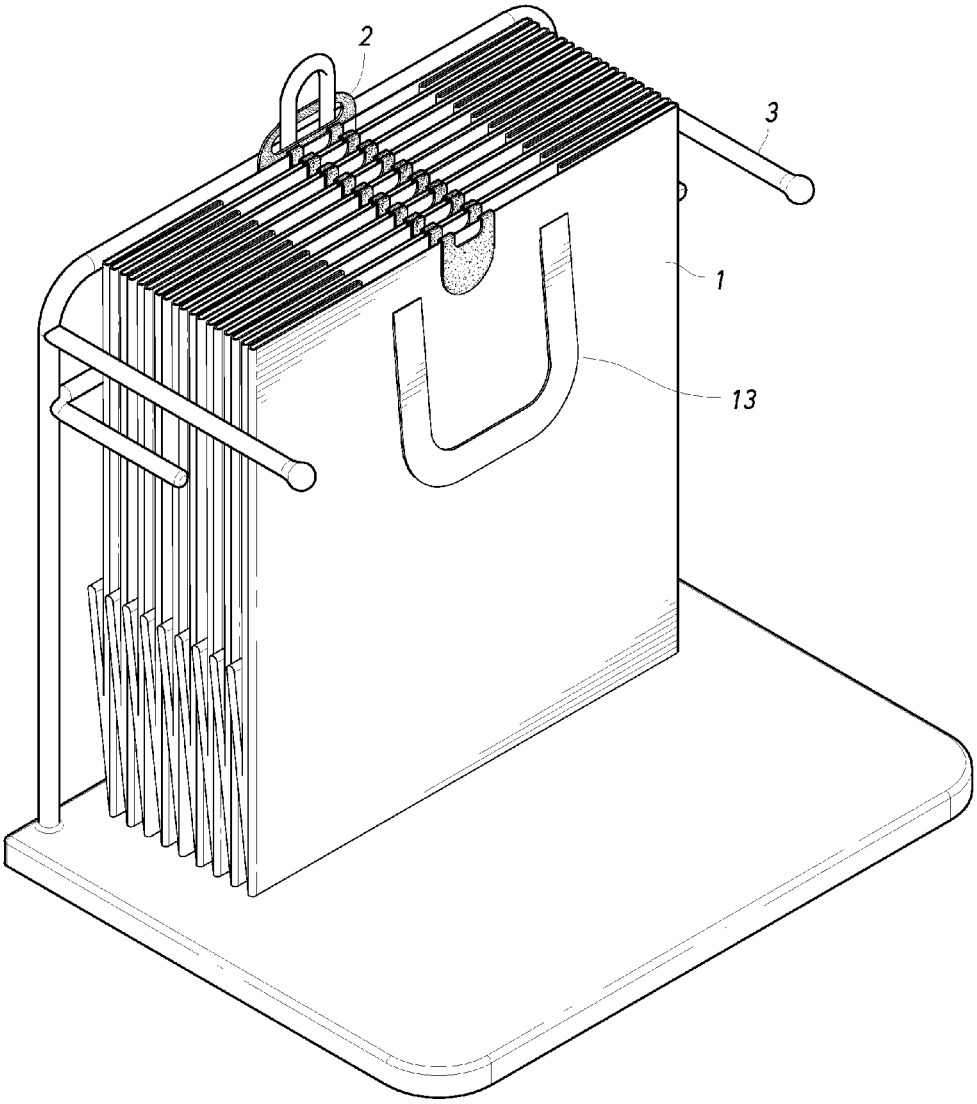
FIG. 2. shows an embodiment with many bags.
Figure 3:
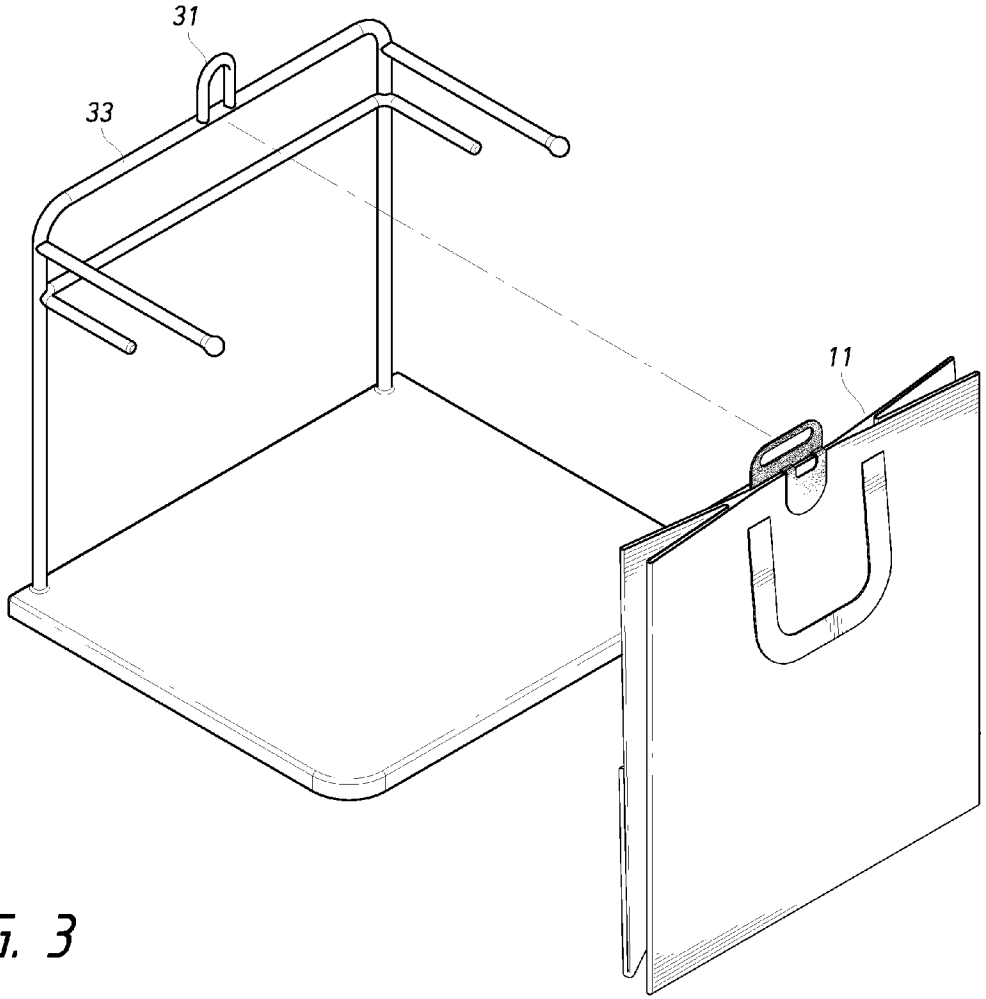
FIG. 3. shows an interaction between an embodiment of the bag and the bag stand.

As can be seen in FIG. 2, multiple bags 1, forming a stack, can be employed. When secured to the bag stand 3, one of the bags 1 will be attached to the fastening section 22, while all the successive bags 1 will be attached to the adjacent bags 1. For example, the first fastener 14 of one bag 1 will be attached to the second fastener 15 of an adjacent bag 1. As discussed in reference to one bag 1, the outer most bag's first fastener 14 is separated from the second fastener 15 and placed in the open position. The bag 1 is then filled and removed from the stack. The next bag 1 then can be placed in a open position and filled. This can be done until the last bag 1 is filled or until there are no more items to be bagged.

Figure 8:
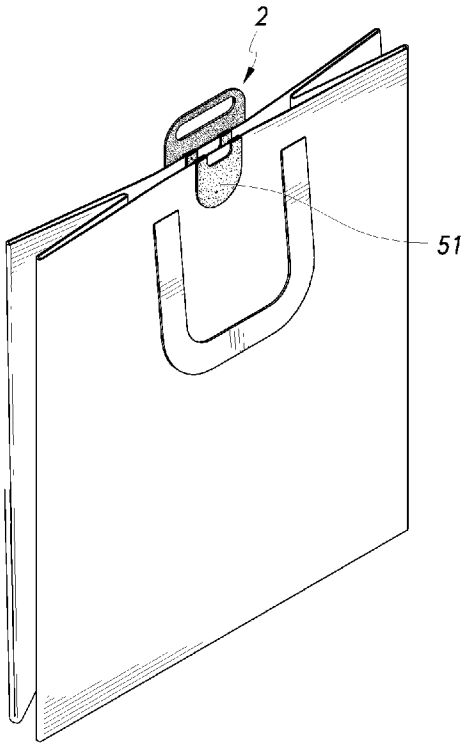
FIGS. 7 and 8 show an embodiment of the fasteners.
Figure 7:
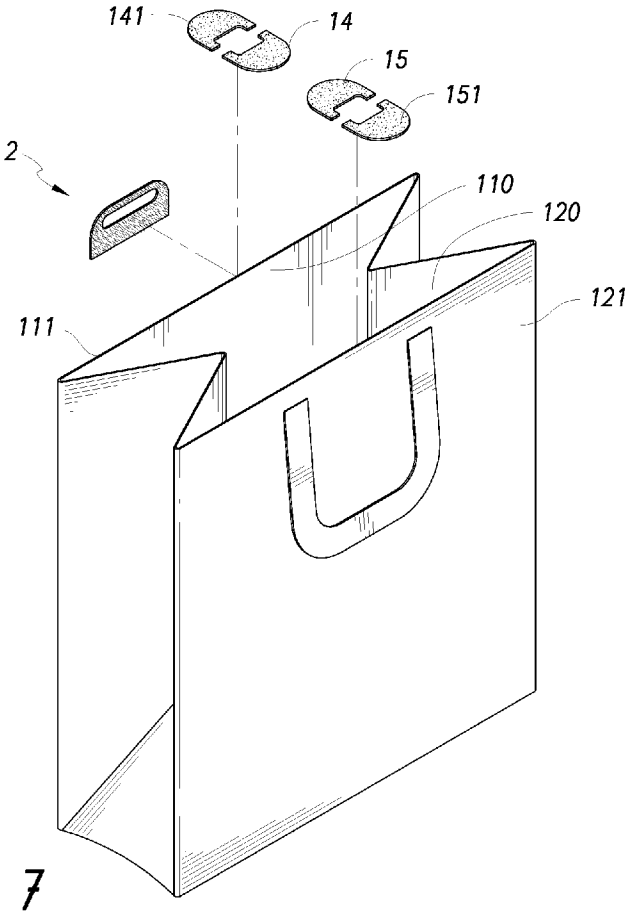

As can be seen in FIGS. 7 and 8, in some embodiments, there are also a third fastener 141 and a fourth fastener 151. In embodiments with the third fastener 141 and the fourth fastener 151, the first fastener 14 is located on the first interior surface 110; the second fastener 15 is located on the second interior surface 120; the third fastener 141 is located on the first exterior surface 111; and the fourth fastener 151 is located on the second exterior surface 121. Additionally, the first fastener 14 and the second fastener 15, as well as the third fastener 141 and the fourth fastener 151 of adjacent bags 1, will be aligned. The operation of the bag(s) 1 is the same as discussed above.

Figure 6:
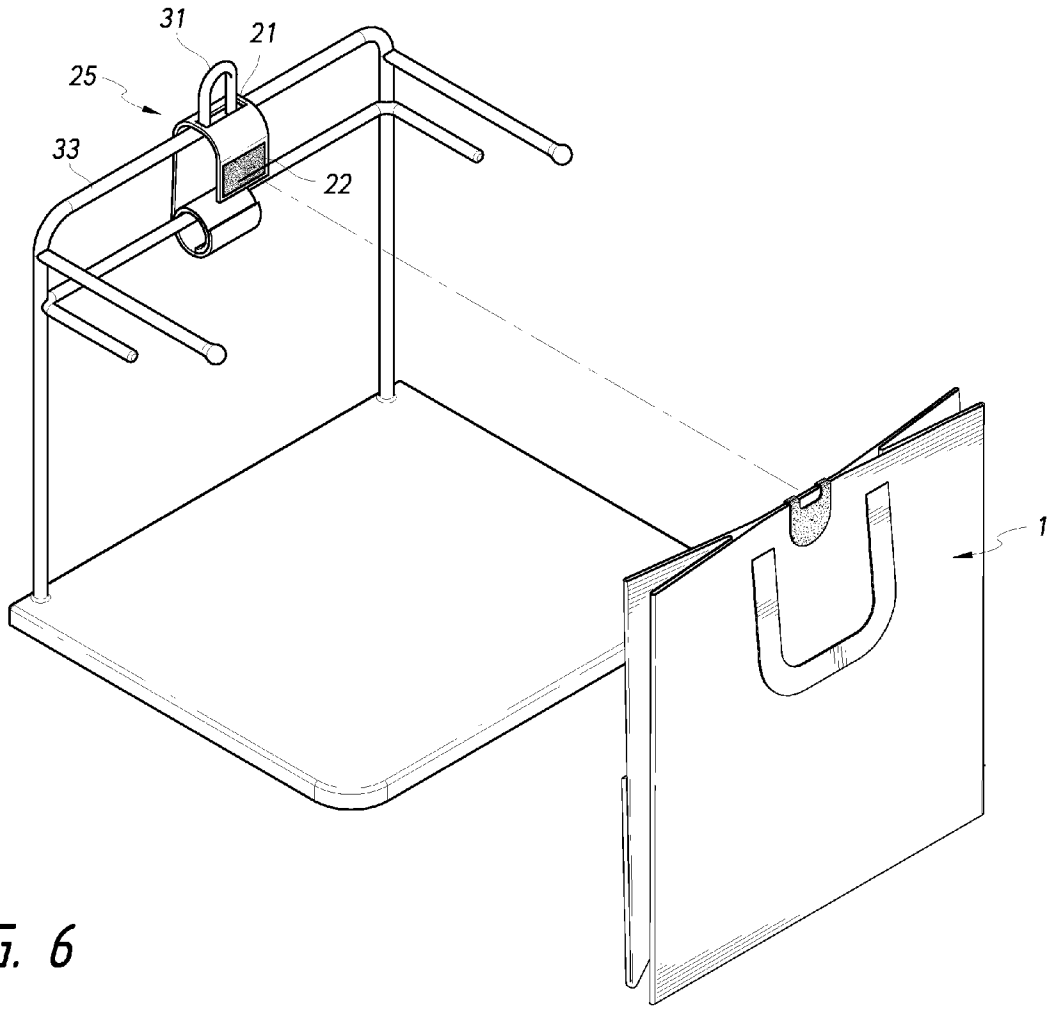
FIG. 6 shows and embodiment of a catch.

Referring to FIG. 6, in some embodiments, an attached catch 25 is attached to the bag stand 3 by means that is separate from the hook 31. The attached catch 25 comprises of a fastening section 22 and is able to be folded over the top portion 33 of the bag stand 3. In some embodiments, the attached catch 25 has a though hole 21 and can slide over the hook 31. The attached catch 25 can be integral with the bag stand 3 or can be removably attached to the bag stand 3.

Figure 9:
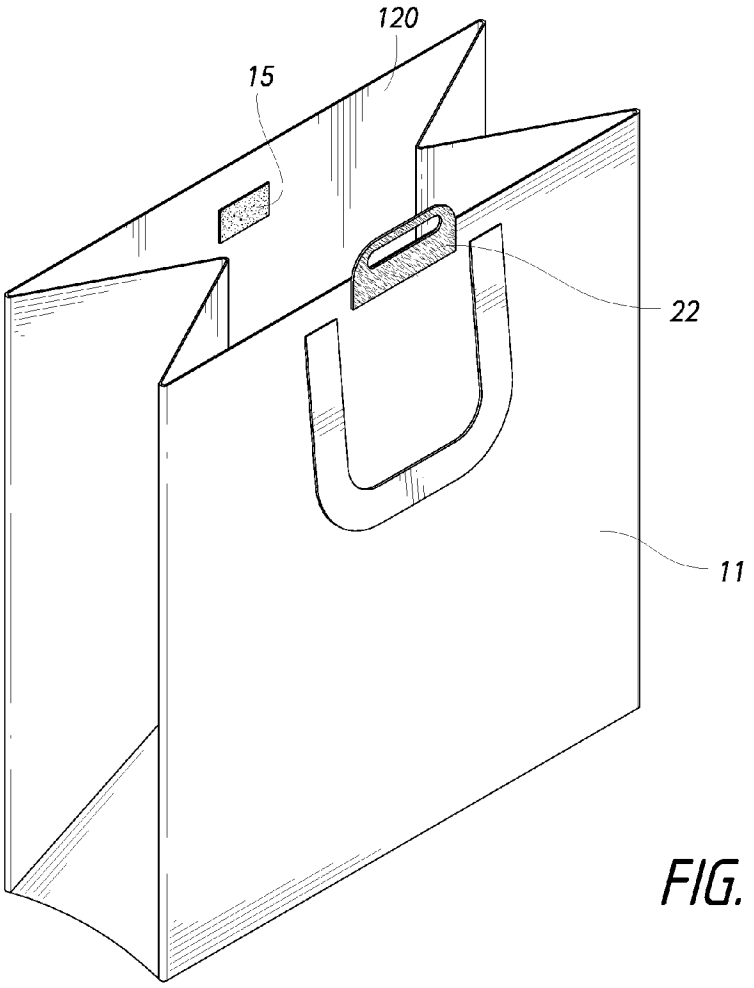
FIG. 9 shows an embodiment of the fasteners.

In some embodiments, the first fastener 14, the second fastener 15, the third fastener 141 (if present) and the fourth fastener 151 (if present) are integral with the bag 1 (as seen in FIG. 9). However in other embodiments, they are applied by means of an adhesive to the panels. An example of which is shown in FIG. 4.

The fasteners can be magnets, buttons, snaps, DUAL LOCK® fasteners, and hook and loop fasteners. In embodiments employing the hook and loop fasteners, the first fasteners 14 and the second fasteners 15, likewise the third fasteners and the fourth fasteners if used, must be the one or the other in order to be properly mated. In some embodiments, the fasteners that are hooks are one color and/or pattern, and the fasteners that are loops are of a different color and/or patterns. In other embodiments, the first exterior surfaces and the second exterior surface 121 have different colors and/or patterns. The different color and/or pattern helps the user properly align the bags 1 so that they will be easily attached to each other to form a stack. It will also assist aligning the proper end of the stack to attach to the catch 2 or the attached catch 25. The same can be said for if magnets are employed. If DUAL LOCK® fasteners is employed for the fasteners, the alignment of the bag(s) 1 in a certain orientation is not a concern, as DUAL LOCK® fasteners can be used on a mirror of itself.

The fasteners and or catches 2 can be sold separately to modify common reusable bags 1. Likewise, attached catches 25 can be sold separately to retailers that use bag stands 3. It is also understood that retailers may purchase bag stands 3 with attached catches 25, permanently or semi-permanently, and sell reusable bags 1 having the fasteners (two or four).

As can be seen in FIGS. 6 and 6, one of the advantages of the bag 1, catch 2, and/or attached catch 25 is that it allows the bag stand 3 to still be used to hold regular plastic bags. Thus when a user comes with a bag 1 or a stack, the person bagging can use a catch 2 and place the hook 31 in the through hole 21, or flip the attached catch 25 over and place the hook 31 though the through hole 21, and easily use the bags 1. The use of this system will decrease the time required to pack reusable bags, decrease labor cost and lines.

Another advantage of the system is that it allows a simple way for the consumer to store their bags 1. The stack of bags 1 shown in FIG. 2, can be used to keep the bags 1 together when not being employed. This will allow the consumer to easily stow the bags 1, such as in the car, without the fear that they will spread all over the trunk.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

What is claimed is:

1. An apparatus comprising:

a bag comprising:

a first panel comprising a first interior surface and a first exterior surface;

a second panel comprising a second interior surface and a second exterior surface;

a first fastener located at approximately top center of the first interior surface; and a second fastener located at approximately top center of the second interior surface;

a third fastener is located on the first exterior surface;

a fourth fastener is located on the second exterior surface;

wherein the bag is able to move between an open position and a closed position; in the closed position, the first fastener is in contact with and releasably secured to the second fastener; and in the open position, the first fastener is not in contact with the second fastener.

2. The apparatus of claim 1, wherein the first fastener is connected to the third fastener, and the second fastener is connected to the fourth fastener.

3. The apparatus of claim 1, further comprising a catch; and the catch comprises a fastener section that is releasably connected to either the third fastener or the fourth fastener.

4. The apparatus of claim 2, further comprising a catch; and the catch comprises a fastener section that is releasably connected to either the first fastener or the second fastener.

5. The apparatus of claim 3, further comprising a bag stand comprising a hook located on a midline of the stand; and the catch defines a though hole, and the hook is located in the through hole.

6. The apparatus of claim 4, further comprising a bag stand comprising a hook located on a midline of the stand; and the catch defines a though hole, and the hook is located in the through hole.

7. The apparatus of claim 1, further comprising a bag stand and a catch; the bag stand comprises a hook located on a midline of the stand; the catch comprises a fastening section, that is releasably connected to either the third fastener or the fourth fastener, and defines a through hole in which the hook is engaged; and the catch is able to rotate in relation to the hook such that the hook is able to disengage from the through hole, but the catch will still be attached to the bag stand.

8. The apparatus of claim 2, further comprising a bag stand and a catch; the bag stand comprises a hook located on a midline of the stand; the catch comprises a fastening section, that is releasably connected to either the first fastener or the second fastener, and defines a through hole in which the hook is engaged; and the catch is able to rotate in relation to the hook such that the hook is able to disengage from the through hole, but the catch will still be attached to the bag stand.

9. The apparatus of claim 1, wherein the first fastener and the second fastener comprise of hook and loop fasteners.

10. The apparatus of claim 1, wherein there is no attractive force biasing the first fastener towards the second fastener, biasing the bag to the closed position.

11. The apparatus of claim 1, further comprising a first handle that is attached to the first panel at two locations, wherein the first fastener is located between the two locations.

12. The apparatus of claim 5, wherein the hook comprises a vertical section.

13. The apparatus of claim 1, wherein the first panel is rectangular; a first handle is attached to the first panel at two locations; and the first fastener is located between the two locations.

* * * * *